US007832488B2

(12) United States Patent
Guerrero et al.

(10) Patent No.: US 7,832,488 B2
(45) Date of Patent: Nov. 16, 2010

(54) ANCHORING SYSTEM AND METHOD

(75) Inventors: Julio Guerrero, Cambridge, MA (US); Kartik M. Varadarajan, Cambridge, MA (US); Martin L. Culpepper, Marblehead, MA (US)

(73) Assignees: Schlumberger Technology Corporation, Cambridge, MA (US); Massachusetts Institute of Technology, Cambridge, MA (US)

( * ) Notice: Subject to any disclaimer, the term of this patent is extended or adjusted under 35 U.S.C. 154(b) by 535 days.

(21) Appl. No.: 11/273,758

(22) Filed: Nov. 15, 2005

(65) Prior Publication Data

US 2007/0256827 A1 Nov. 8, 2007

(51) Int. Cl.
*E21B 33/12* (2006.01)

(52) U.S. Cl. ..... 166/382; 166/387; 166/120; 166/187; 166/212

(58) Field of Classification Search ..... 166/382, 166/387, 118, 134, 187, 212, 120, 122; 405/259.1, 405/259.4

See application file for complete search history.

(56) References Cited

U.S. PATENT DOCUMENTS

| | | | | |
|---|---|---|---|---|
| 3,130,787 | A * | 4/1964 | Mason | 277/333 |
| 3,982,248 | A | 9/1976 | Archer | 343/840 |
| 4,105,215 | A * | 8/1978 | Rathburn | 277/342 |
| 4,424,861 | A * | 1/1984 | Carter et al. | 277/334 |
| 5,010,958 | A * | 4/1991 | Meek et al. | 166/382 |
| 5,027,894 | A * | 7/1991 | Coone et al. | 166/122 |
| 5,448,867 | A | 9/1995 | Wilson | 52/641 |
| 5,542,473 | A * | 8/1996 | Pringle | 166/120 |
| 6,135,210 | A * | 10/2000 | Rivas | 166/372 |
| 6,248,096 | B1 | 6/2001 | Dwork et al. | 604/349 |
| 6,299,173 | B1 | 10/2001 | Lai | 277/348 |
| 6,379,071 | B1 | 4/2002 | Sorvino | 403/13 |
| 6,513,601 | B1 * | 2/2003 | Gunnarsson et al. | 166/387 |
| 6,725,934 | B2 | 4/2004 | Coronado et al. | |
| 6,827,150 | B2 * | 12/2004 | Luke | 166/387 |
| 2004/0097876 | A1 | 5/2004 | Shkolnik | 604/103 |
| 2005/0090893 | A1 | 4/2005 | Kavteladze et al. | 623/1.15 |

(Continued)

FOREIGN PATENT DOCUMENTS

| | | |
|---|---|---|
| EP | 0 101 805 B1 | 12/1986 |
| EP | 0 106 016 B1 | 12/1986 |
| EP | 0 118 619 B1 | 9/1988 |

(Continued)

*Primary Examiner*—Daniel P Stephenson
*Assistant Examiner*—Robert E Fuller
(74) *Attorney, Agent, or Firm*—Brigid Laffey; Vincent Loccisano; James McAleenan

(57) ABSTRACT

An anchoring module capable of being secured within a structure includes at least one compliant ring configured to radially expand and an expandable device positioned within the compliant ring to expand the compliant ring from a relaxed state to interface with the structure. The anchoring module is part of a modular system used to harvest fluid, such as oil or natural gas from a structure, such as a pipe or well. Another module of the system, sometimes referred to as a support or back-up module, employs an expandable surface that is capable of expanding to the diameter of the interior of the borehole. These modules may be combined in a variety of configurations to support a sealing element, such as an inflatable sealing element. The self-conforming nature of the system obviates the need for prior knowledge of the structure or complex sensor systems to chart the structure. The anchoring module can also be utilized in a crawling system to convey tools inside a structure.

32 Claims, 11 Drawing Sheets

U.S. PATENT DOCUMENTS

2007/0261863 A1* 11/2007 Macleod et al. ..... 166/387

FOREIGN PATENT DOCUMENTS

| | | | |
|---|---|---|---|
| EP | 0 443 408 | B1 | 2/1994 |
| EP | 0 455 850 | B1 | 5/1995 |
| EP | 1 005 884 | A2 | 6/2000 |
| EP | 1 005 884 | A3 | 6/2000 |
| EP | 1 072 295 | A2 | 1/2001 |
| EP | 1 072 295 | A3 | 1/2001 |
| EP | 1 219 754 | A1 | 7/2002 |
| GB | 2368082 | A | 4/2002 |
| GB | 2371066 | A | 7/2002 |
| WO | 97/27369 | A1 | 7/1997 |
| WO | 02/063111 | A1 | 8/2002 |
| WO | 03/054318 | A2 | 7/2003 |
| WO | 03/054318 | A3 | 7/2003 |
| WO | 04/000137 | A2 | 12/2003 |
| WO | 04/000137 | A3 | 12/2003 |

* cited by examiner

ANCHORING SYSTEM AND METHOD

FIELD OF THE INVENTION

The present invention relates to expandable compliant structures used in pipes or boreholes, and more particularly, to an anchoring system and an expandable support module that may be used, in one embodiment, to seal off sections in a pipe or well within an oil drilling system. The system can conform to any cross sectional topology and can expand to variable diameter ratios. Furthermore, the system can also collapse by itself due its capacity to store potential energy when it is expanded. In addition to anchoring, this system may be adapted to deploy tools for inspection of the drilled well bores or for exploratory robots.

BACKGROUND OF THE INVENTION

In oil and natural gas exploration, after a borehole has been drilled and a casing or open hole has been cemented within the borehole, one or more sections of the casing or open hole adjacent pay zones (e.g., reservoirs containing valuable resources, such as oil or natural gas) are perforated to allow fluid from the surrounding formation to flow into the well for production to the surface. Perforating guns are lowered into the borehole and the guns are fired to create openings in the casing or open hole and to extend perforations into the surrounding formation.

A production tubing may be inserted into the borehole to recover the fluid. Sealing devices may be used to seal off or otherwise block the formation and borehole fluids from the annulus between the production tubing and the casing or open hole during recovery of the fluid. Such devices may also be used for performing other operations within the casing or open hole. One such device is known as a packer, which is used in combination with reinforcing material (e.g., wire mesh). The packer may include at least one inflatable element that is used to seal off the passageway defined by the casing or open hole. One of the shortcomings associated with the use of packers is that the inflatable element may be subject to being extruded through the reinforcing material when the device is exposed to increased axial pressures and/or temperatures caused by the fluid.

The present invention relates, in part, to systems and techniques used to seal off the borehole during production or other operations. Of course, such systems may be used to block or otherwise seal other passageways as well. The systems may relate to anchoring systems that can be used to hold other components, such as logging tools, in specific positions within the well. The systems may also relate to crawling systems used to convey tools in horizontal and deviated wells.

SUMMARY OF THE INVENTION

An aspect of the present invention is directed to an anchoring module adapted to be secured within a structure. In one embodiment, the anchoring module comprises at least one compliant ring adapted to radially expand from a substantially relaxed position, and an expandable device positioned within the at least one compliant ring to expand the at least one compliant ring from its substantially relaxed position to interface with the structure.

Embodiments of the anchoring module may include the at least one compliant ring comprising a plurality of structural segments circumferentially arranged around the at least one compliant ring. In certain embodiments, each structural segment may be generally wedge-shaped. Each structural segment may be connected to one another by at least one interconnecting compliant portion and may be adapted to move radially outwardly with respect to structural segments of an adjacent compliant ring. The arrangement is such that two or more compliant rings may be positioned adjacent one another along a common axis, wherein segments of adjacent compliant rings may be aligned with respect to each other by at least one pin. The at least one compliant ring may be configured to be expandable from the substantially relaxed position to an expanded position. The at least one compliant ring may be configured such that the maximum diameter of the at least one compliant ring in its expanded position is approximately 1.69 times greater than the diameter of the at least one compliant ring in its substantially relaxed position. In further embodiments, the expandable device may comprise an inflatable bladder.

The anchoring module may further comprise a shaft and a pair of end caps in which the at least one compliant ring and the inflatable bladder may be positioned on the shaft between the pair of end caps. A sealing element may be further provided to block an interior of the structure. The arrangement is such that the at least one compliant ring, the expandable device and the sealing element may be mounted on the shaft.

Another aspect of the invention is directed to an anchoring module adapted to be secured within a structure. The anchoring module comprises at least one compliant ring adapted to radially expand from a substantially relaxed position, and means for expanding the at least one compliant ring from its substantially relaxed position to interface with the structure.

Certain embodiments of the anchoring module may include the at least one compliant ring comprising a plurality of structural segments circumferentially arranged around the at least one compliant ring. Each structural segment may be connected to one another by at least one interconnecting compliant portion, and may be adapted to move radially outwardly with respect to structural segments of an adjacent compliant ring. The arrangement is such that two or more compliant rings may be positioned adjacent one another along a common axis, wherein segments of adjacent compliant rings may be aligned with respect to each other by at least one pin. The at least one compliant ring may be configured to be expandable from the substantially relaxed position to an expanded position. The at least one compliant ring may be configured such that the maximum diameter of the at least one compliant ring in its expanded position is approximately 1.69 times greater than the diameter of the at least one compliant ring in its substantially relaxed position. In further embodiments, the means for expanding the at least one compliant ring may comprise an inflatable bladder.

The anchoring module may further comprise a shaft and a sealing element adapted to block an interior of the structure. The arrangement is such that the at least one compliant ring, the means for expanding the at least one compliant ring, and the sealing element may be mounted on the shaft.

A further aspect of the invention is directed to a system for sealing a structure. In one embodiment, the system comprises an anchoring module adapted to interface with an interior surface of the structure, and a support module adapted to transfer a load to the anchoring module.

Embodiments of the system may include the support module comprising a base, and a plurality of support elements coupled to the base. The plurality of support elements may be moveable from a collapsed configuration to an operable configuration in which the plurality of support elements expand radially along a plane generally perpendicular to an axis of the structure. Adjacently positioned support elements may be connected to one another by compliant linkages. The support module may further comprise at least one compliant link to connect the base and the plurality of support elements.

The system may further comprise a sealing element adapted to block an interior of the structure with the plurality of support elements being adapted to interface with the sealing element. The anchoring module may comprise at least one compliant ring adapted to radially expand from a substantially relaxed position, and an expandable device positioned within the at least one compliant ring to expand the at least one compliant ring from its substantially relaxed position to interface with the structure. The at least one compliant ring may comprise a plurality of structural segments circumferentially arranged around the at least one compliant ring. Each structural segment may be connected to one another by at least one interconnecting portion, and adapted to move radially outwardly with respect to adjacent structural segments. The expandable device may comprise an inflatable bladder. A pair of end caps may be further provided wherein the at least one compliant ring and the inflatable bladder may be positioned between the pair of end caps. The system may further comprise a shaft and a sealing element adapted to block an interior of the structure. The support module may be adapted to interface with the sealing element. The anchoring module, the support module and the sealing element may be mounted on the shaft.

Yet another aspect of the present invention is directed to a method of sealing a structure comprising securing a compliant device to an interior surface of the structure, and supporting a sealing device with the compliant device. In certain embodiments, the sealing device may comprise a sealing element. The method may further comprise transferring a load provided by the sealing device on the anchoring module with a support module positioned between the anchoring module and the sealing device.

BRIEF DESCRIPTION OF THE DRAWINGS

In the drawings, like reference characters refer to the same or similar parts throughout the different views. The drawings are not necessarily to scale, emphasis instead being placed upon illustrating particular principles, discussed below.

DETAILED DESCRIPTION OF THE INVENTION

Figure 1:
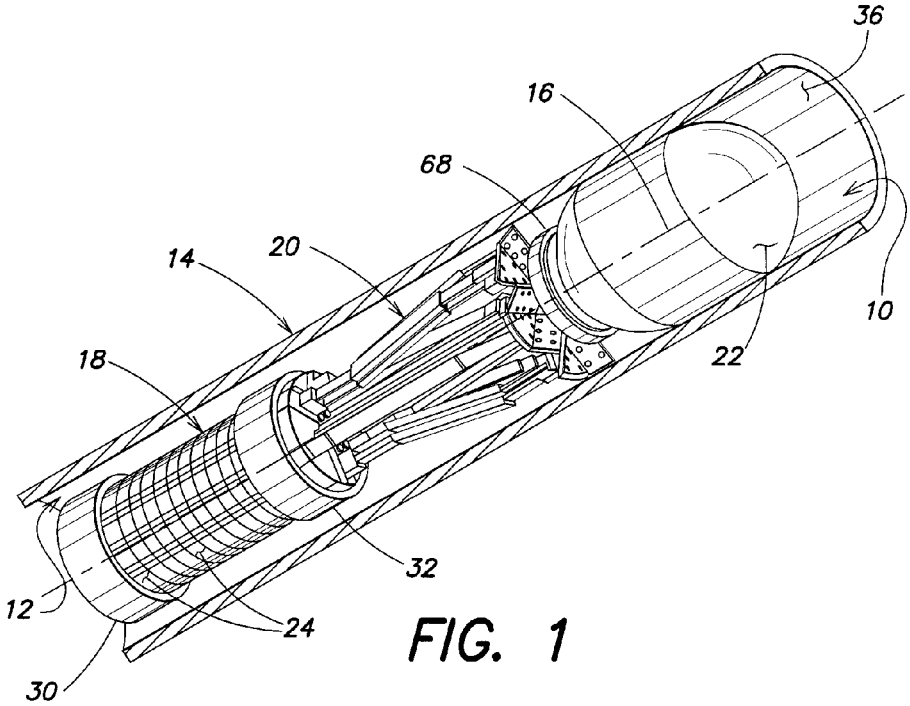
FIG. 1 is a perspective view of a system of an embodiment of the present invention used for sealing or sealing a generally tubular structure, such as a pipe or borehole, which is shown throughout the drawings in cross-section to show components of the system.

For the purposes of illustration only, and not to limit the generality, the present invention will now be described in detail with reference to the accompanying figures. This invention is not limited in its application to the details of construction and the arrangement of components set forth in the following description or illustrated in the drawings. The invention is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Some embodiments of the present invention are directed to systems for blocking or sealing an interior of a generally tubular structure, such as a pipe or a borehole used to characterize and/or produce fluid, such as oil or natural gas. Other embodiments are directed crawling systems used to convey tools in horizontal or deviated wells. Additional embodiments are directed to apparatuses adapted to hold devices in specific positions inside the tubular structures. An example of such a tubular structure is shown in the drawings as being circular in cross-section; however, as will be discussed below in greater detail, each described system is capable of sealing pipes that are not circular in cross-section, but instead are elliptical or oblong or otherwise asymmetrical in cross-section, for example. Prior blocking devices are particularly suited for sealing pipes having uniform circular cross-sections, and in most instances, are incapable of sealing pipes that, for whatever reason, are not circular. In some embodiments, the tubular structure is in the form of a borehole, which in certain instances may further include a casing, and in other instances may define an open hole. When employing a casing, the casing may comprise a pipe cemented to the borehole structure that is provided to define a passageway for fluids to travel. As used herein, "borehole" shall describe any generally tubular structure or open hole in which a device is capable of being anchored or otherwise secured within the passageway of the tubular structure. For the purpose of this application, "borehole" is intended to include cased holes and open holes. One skilled in the art would appreciate that this invention may be used in pipes whether inside or outside of the oilfield industry.

Certain embodiments of the present invention utilize the advantages of compliant mechanisms that adapt their configuration to surfaces having varying shapes and contours. Specifically, certain embodiments of the invention include an expandable system that uses a compliant mechanism to conform to geometrical variations along an axis and cross section of the borehole and to anchor the system within the borehole. Such a system may be self-retracting for subsequent removal or relocation of the system from the borehole. The system may include several modules designed to interact with one another to block or seal the passageway of the borehole.

One module of the system may be designed to anchor the system to an interior surface of the borehole. Another module of the system, sometimes referred to as a back-up module, employs an expandable surface that is capable to expand to the diameter of the interior of the borehole. These modules may be combined in a variety of configurations to support a sealing device, such as an inflatable sealing element.

In one embodiment, the anchoring module is a set of compliant rings capable of expanding to conform to the interior surface of the borehole. The arrangement is such that several compliant rings are arranged in series along an axis of the borehole. When expanded, the compliant rings expand radially outwardly to engage and secure the anchoring module within the borehole. One advantage associated with such systems is that the modules may conform to boreholes having varying or asymmetrical cross sectional profiles.

Referring now to the drawings, and more particularly to FIGS. 1-4, there is generally indicated at 10 a system of an embodiment of the present invention designed to block or otherwise seal a passageway 12 within a borehole 14. As shown, the system 10 extends along an axis 16 defined by the borehole 14. The system 10 of the embodiment shown in FIGS. 1-4 includes three modules or components, which are an anchoring module generally indicated at 18, a support module generally indicated at 20, and a sealing element generally indicated at 22. These modules may be arranged to block or otherwise seal the passageway 12 of the borehole 14. These modules may also be used separately to perform other functions within the borehole 14 or another tubular structure. For example, the anchoring module 18 may be used to anchor or secure a processing component within a tubular structure. Examples of such other uses of the modules will be described in greater detail below.

Figure 2:
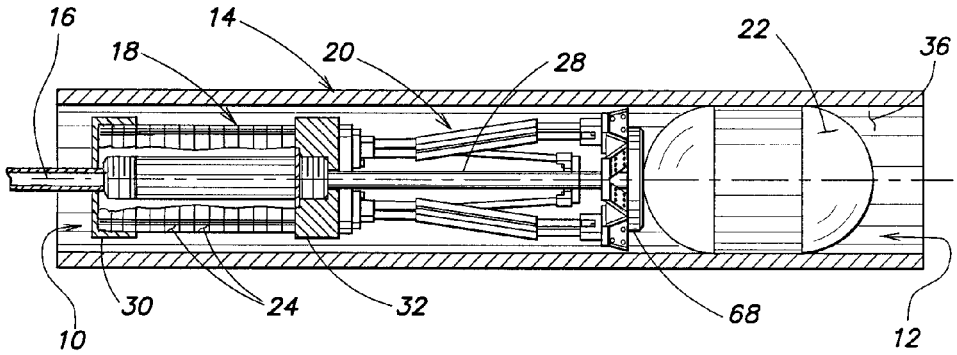
FIG. 2 is a side elevational view of the system illustrated in FIG. 1.
Figure 3:
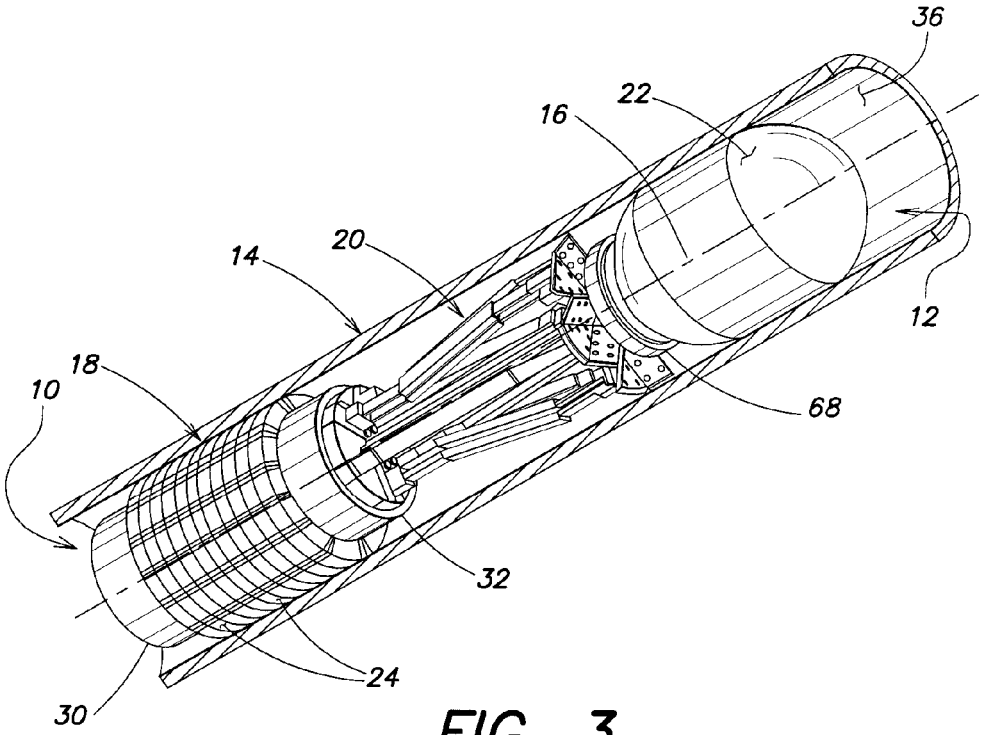
FIG. 3 is a perspective view of the system shown in FIG. 1 with an anchoring module of an embodiment of the invention shown in a secured position within the tubular structure.
Figure 4:
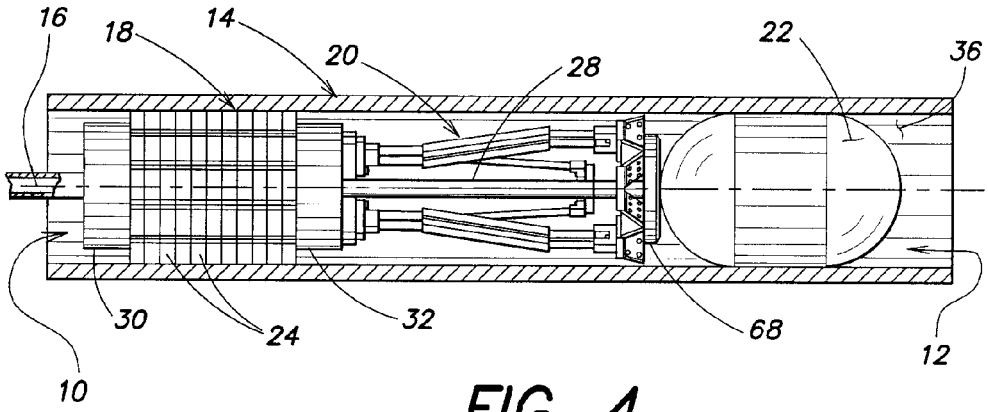
FIG. 4 is a side elevational view of the system shown in FIG. 3.
Figure 5:
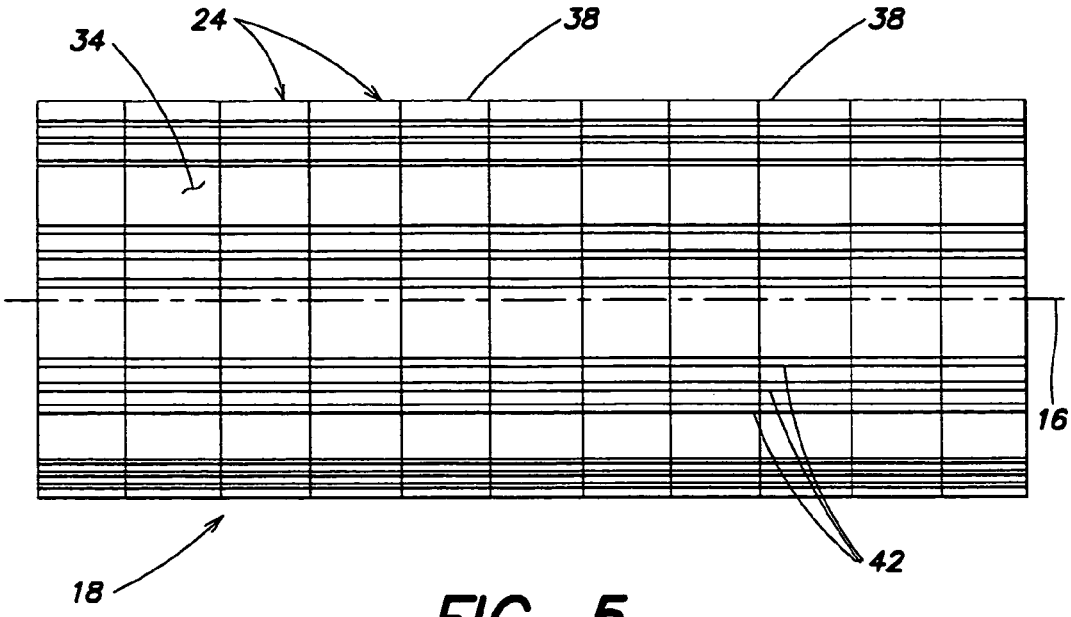
FIG. 5 is a side perspective view of an anchoring module of an embodiment of the invention.
Figure 6:
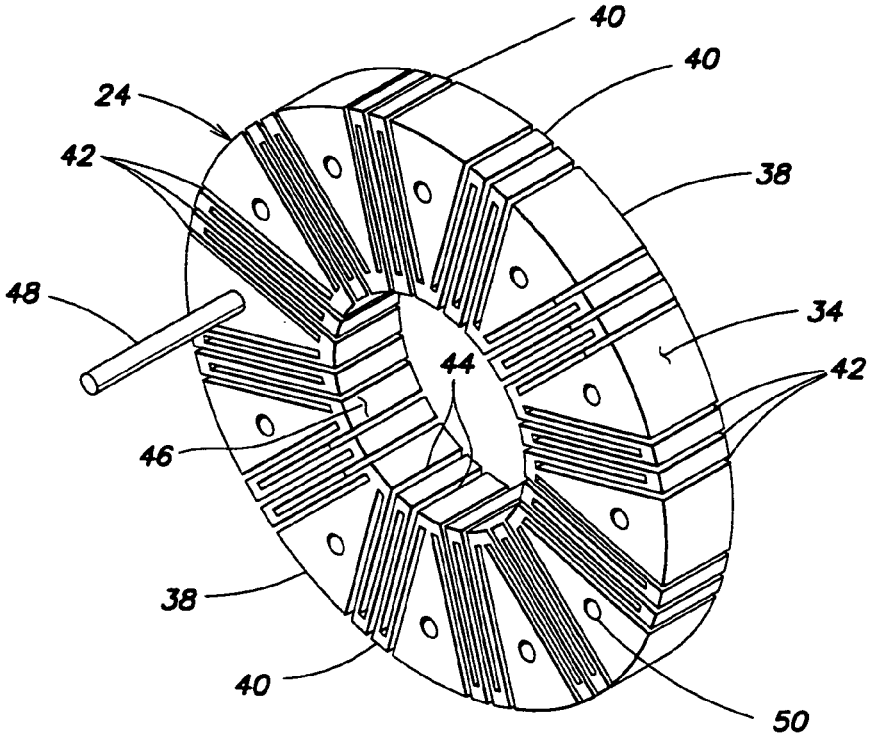
FIG. 6 is a perspective view of a compliant ring of an embodiment of the invention.
Figure 7:
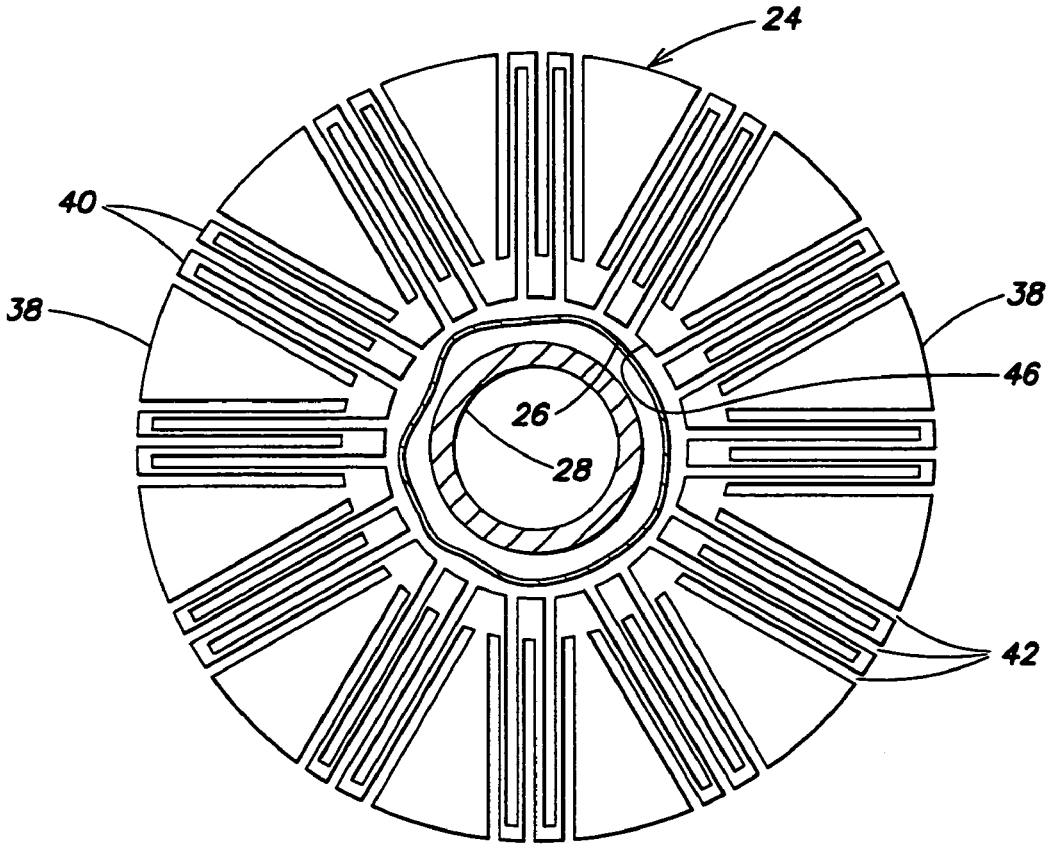
FIG. 7 is an end view of the compliant ring shown in FIG. 6.

Still referring to FIGS. 1-4, and with further reference to FIGS. 5-7, the anchoring module 18 includes a series of compliant rings, each indicated at 24, which are each adapted to radially expand from a substantially relaxed position (FIGS. 1 and 2) to an expanded position (FIGS. 3 and 4). The anchoring module 18 further includes an expandable device, such as an inflatable bladder 26 (FIG. 7), designed to expand the compliant rings 24 from their biased relaxed position to their expanded position. FIG. 7 illustrates the inflatable bladder 26 in a deflated condition. It is understood that any suitable device designed to expand the compliant rings, such as a mechanical device, may be used in place of the inflatable bladder 26 and still fall within the scope of the present invention. The compliant rings 24 and the inflatable bladder 26 are positioned over a shaft 28, and are held in place axially along the length of the shaft by a pair of clamps (not shown). As shown, the compliant rings 24 and the inflatable bladder 26 are positioned between end caps 30, 32, wherein the end caps are suitably secured to the shaft 28. The end caps 30, 32 can also be made of a set of compliant rings. If compliant, the expansion ratio of the anchoring module may not be limited to the initial outer diameter of the module, but by the expansion ratio of the compliant end caps.

FIGS. 1 and 2 show the compliant rings 24 of the anchoring module 18 in their relaxed position in which there is a space between outer surfaces 34 (see FIG. 5 for outer surface 34 of each compliant ring 24) of the compliant rings 24 and the interior surface 36 of the borehole 14. FIGS. 3 and 4 illustrate the compliant rings 24 in their expanded position in which the anchoring module 18 is adapted to move toward and engage the interior surface 36 of the borehole 14. The arrangement is such that by activating the inflatable bladder 26, the compliant rings 24 expand radially outwardly along a plane perpendicular to the direction of the axis 16. Once the anchoring module 18 engages the interior surface 36 of the borehole 14 so that the compliant rings 24 are forced or compressed against the borehole 14, the anchoring module is suitably secured so that it is prevented from moving axially with respect to the borehole. In this position, the anchoring module 18 is capable of counteracting axial forces exerted on the anchoring module by the support module 20 and/or the sealing element 22.

In one embodiment, the compliant ring 24 may be fabricated from any suitable polymeric or plastic material. Other materials include, and are not limited to, steel, beryllium copper, titanium, etc.

Referring to FIG. 5, as shown, the series of compliant rings 24 are arranged side-by-side along axis 16. The strength of the anchoring module 18 is dependent on two primary components—the expanding force exerted by the inflatable bladder 26 on the compliant rings 24 and the number of compliant rings provided. As will be described in greater detail below, incremental increases in pressurized fluid delivered to the inflatable bladder 26 through the shaft 28 greatly increase the holding/friction force of the anchoring module 18 within the borehole 14. In addition to increasing the pressurized fluid, by increasing the number of compliant rings 24, the surface area defined by outer surfaces 34 of the anchoring module 18 is increased, thereby providing a greater holding/friction force. FIG. 5 illustrates eleven compliant rings 24 arranged in side-by-side configuration. It should be understood that any number of compliant rings 24 may be provided, depending on the desired strength of securement of the anchoring module 18. As alluded to above, for systems requiring particularly strong securement, the number of compliant rings 24 may be increased to provide a greater surface area and therefore a greater holding force.

Each compliant ring 24 includes a plurality (e.g., twelve) of generally triangular- or wedge-shaped structural segments, each indicated at 38, that are circumferentially arranged about the axis 16. Each structural segment 38 is attached to its adjacent structural segment 38 by interconnecting portions, each indicated at 40. As shown, the compliant ring has a series of slits or notches 42, 44 extending inwardly from its outer diameter (slits 42) and extending outwardly from the inner diameter (slits 44) that together define the structural segments 38 and the interconnecting portions 40. The compliant ring 24 may be molded to the configuration shown in FIGS. 5-7, or processed to have the slits machined on a blank ring, for example.

The arrangement is such that the outer surfaces 34 of the compliant rings 24 are adapted to engage the interior surface 36 of the borehole 14 and inner surfaces 46 of the compliant rings are adapted to engage the inflatable bladder 26. Specifically, each structural segment 38 is adapted to move radially outwardly with respect to its adjacent structural segments. This capability is particularly beneficial for boreholes that are not circular in cross section, but are oblong or otherwise imperfect in cross section, for example. The structural segments 38 of adjacent compliant rings 24 may be aligned with one another by a pin 48 that extends through openings 50 the structural segments in the manner shown in FIG. 6. The segments are aligned with one another in order to have them conform with to geometrical variations along the axis of the tubular environment in which they are used. The segments of the rings can move radially outwardly as much as the topology of the well requires due to the pins and their relative alignment.

In certain embodiments, pressurized fluid (e.g., air or hydraulic fluid) is delivered to the inflatable bladder 26 through the shaft 28 in the well known manner. When pressurized, the inflatable bladder 26 expands the compliant rings 24 toward the interior surface 36 of the borehole 14. Specifically, the interconnecting portions 40 allow the structural segments 38 to move apart from each other and therefore radially outwardly to expand the overall diameter of the compliant ring 24. The inflatable bladder 26 is expanded by introducing pressurized fluid through the shaft and into the inflatable bladder thereby expanding the diameter of the inflatable bladder. The inflatable bladder's dimensions and material properties may be selected based on certain factors, such as climate conditions and the pressure of fluid being delivered to the bladder. The inflatable bladder 26 is secured to the shaft 28 such as with clamps (not shown). The end caps 30, 32, assist in ensuring that the inflatable bladder 26 expands properly within the compliant rings 24 to transfer the radial load to the compliant rings and the axial load to the end caps. In certain embodiments, the compliant rings 24 are capable of expanding to a maximum diameter that is approximately 1.69 times greater than the diameter of the compliant rings when they are in their relaxed state. Of course, the compliant rings may be designed to expand to a larger or smaller diameter depending on the borehole and shaft diameters and the material they are made of.

The anchoring module 18 may generate large anchoring forces with small input pressure delivered to the inflatable bladder 26. Table 1 shows, for different internal inflatable bladder pressure levels, the axial load that can be exerted on an anchoring module 18 before it slips with respect to an elliptical cross section borehole. These values are obtained for compliant rings made from plastic material and with a system that is 0.5 ft long, e.g., approximately eleven rings.

TABLE 1

| Inflatable Bladder Pressure (PSI) | Maximum Axial Load (LBS) |
|---|---|
| 31.5 | 420 |
| 60 | 815 |
| 90 | 1240 |
| 120 | 1750 |
| 130 | 1930 |
| 135 | 2100 |

As shown, the anchoring module 18 is capable of being solidly secured within the borehole 14 so as to support large axial loads. The benefits associated with this capability will become apparent as the description of the system 10 proceeds.

Thus, it should be observed that the anchoring module 18 may conform not only to any cross sectional profile, but also to any topology along the axis of the well or tubular environment in which it is deployed. In addition, the anchoring module 18 stores potential energy that allows it to retract to its collapsed state by itself without external forces.

Figure 8:
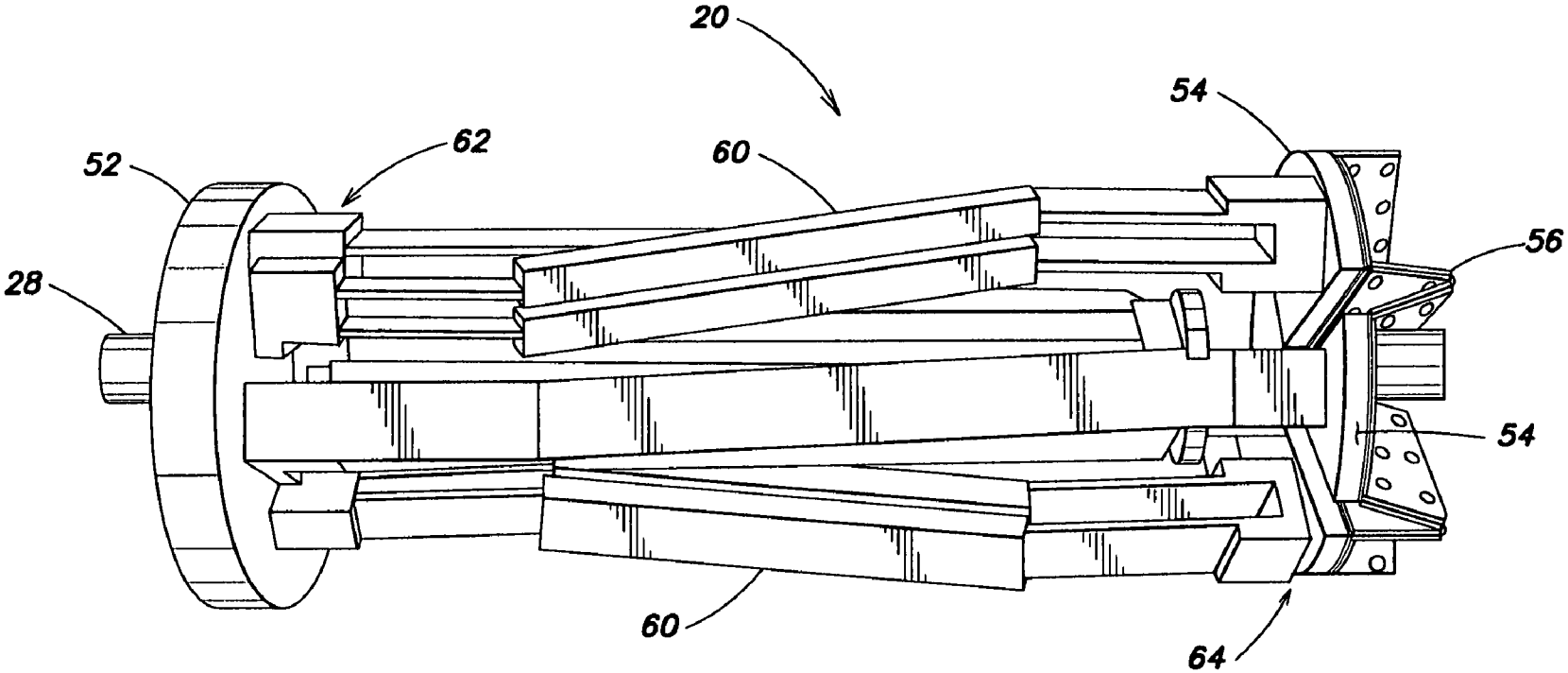
FIG. 8 is a side perspective view of a support module of an embodiment of the invention with the support module being shown in a collapsed configuration.
Figure 9:
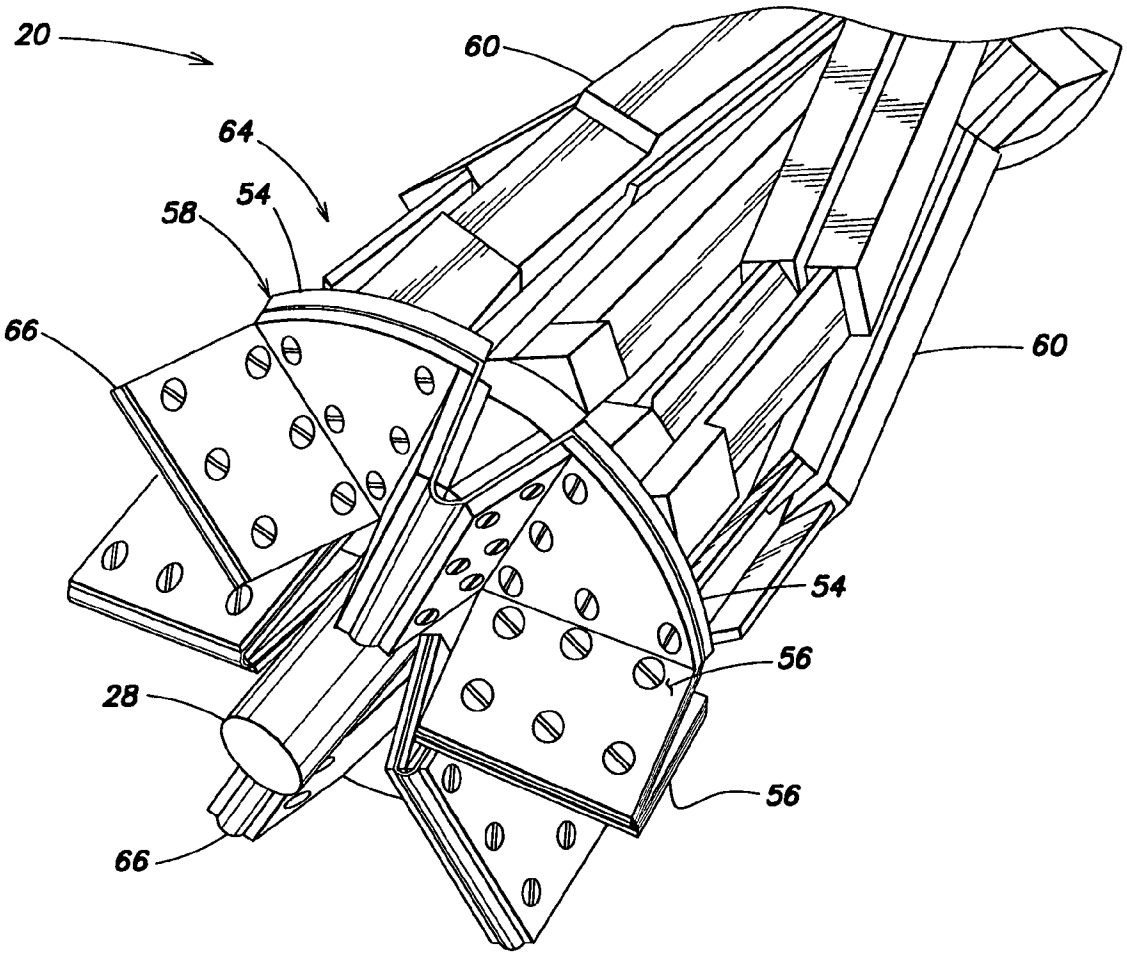
FIG. 9 is a side perspective view of the support module shown in FIG. 8 with the support module being shown in a collapsed configuration.
Figure 10:
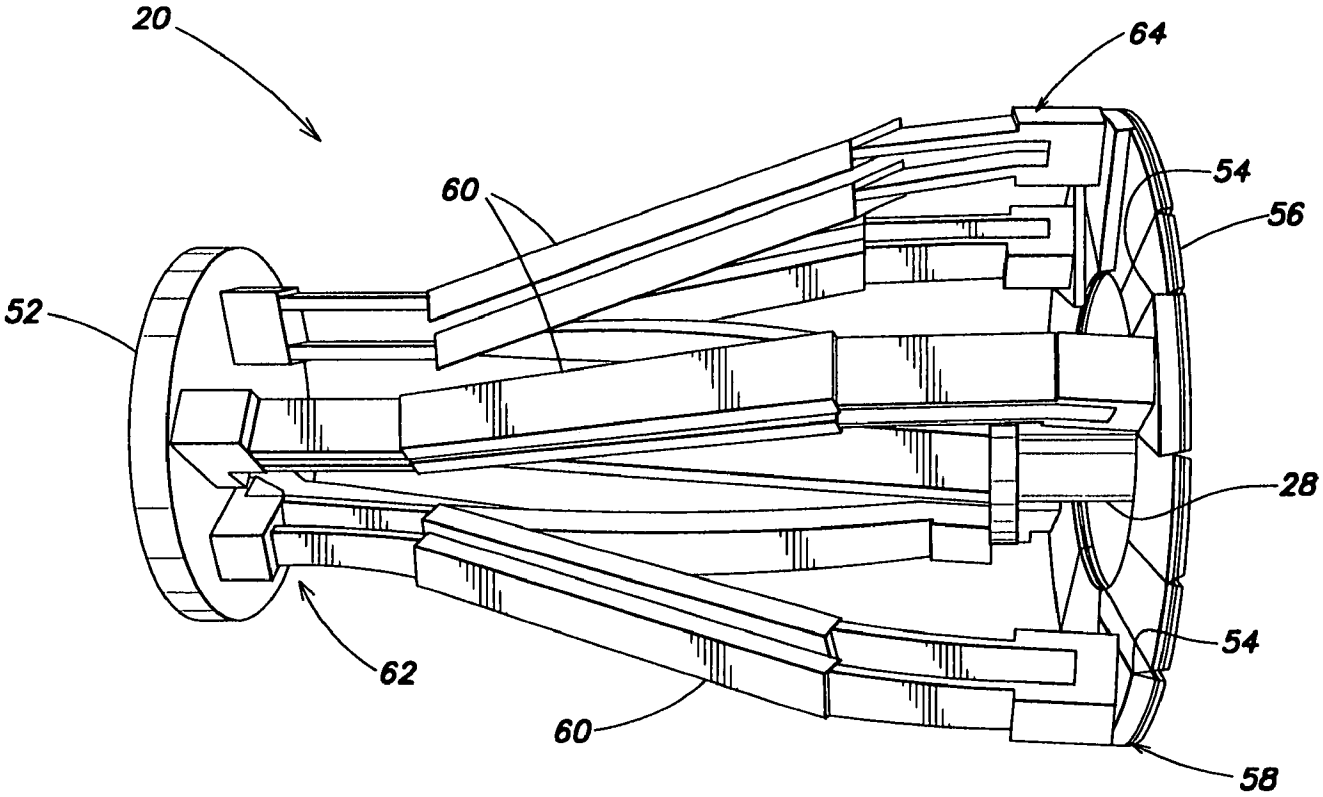
FIG. 10 is an end perspective view of the support module shown in FIG. 9 in a deployed configuration.

Turning now to FIGS. 8-10, one embodiment of the support module 20 is illustrated with the support module being shown in a collapsed configuration in FIGS. 8 and 9 and in an operable configuration in FIG. 10. Specifically, the support module 20 includes a circular base 52 and a plurality of support elements 54, 56 arranged to create a disk 58 about the shaft 28. As shown, several (e.g., six) resilient links, each indicated at 60, connect the base 52 to the disk 58. The arrangement is such that the shaft 28 extends through the base 52 and the disk 58 of support elements, with the resilient links 60 extending circumferentially along axes generally parallel to the axis of the shaft 28. In one embodiment, there are six links 60 that transfer loads from the plurality of support elements 54, 56 to the base 52, which in turn transfers the load to the anchoring module 18. However, it should be understood that any number of links 60 may be provided based on load requirements, for example, and still fall within the scope of the present invention. One end 62 of each link 60 is connected to the base 52 (by pins, for example), and the end 62 can pivot between another structure, such as shims, for example. The other end 64 of the link 60 is secured to a triangular-shaped support element 54 (also by machine screws, for example). The support module 20 may be fabricated from any number of rigid materials, such as plastic, steel, beryllium copper, titanium, etc.

Each triangular-shaped support element 54 is connected by a compliant hinge 66 to an adjacent rectangular-shaped support element 56, which in turn is attached to another rectangular-shaped support element 56 by another compliant hinge 66. The support elements are hingedly attached to one another by the compliant hinges 66 to create the array 58. The arrangement is such that each rectangular-shaped support elements 56 has another rectangular-shaped support element 56 and a triangular-shaped support element 54 attached to it by two separate compliant hinges 66. This configuration enables the movement of the support module 20 from its collapsed configuration to its operable configuration upon receiving an axial force applied to the support elements 54, 56. In particular, the disk 58 formed by the support elements 54, 56 expands radially along a plane generally perpendicular to the long axis extending through the anchoring module 18 and the borehole 14 as illustrated in FIG. 10.

Referring back to FIGS. 1-4, the arrangement is such that an axial force, such as a force applied by the sealing element 22 engages the support module 20, which in turn transfers the force to the anchoring module 18. As shown, an intermediate support member 68 may be positioned between the sealing element 22 and the support module 20. The purpose of such an intermediate support member 68 is to provide a smooth surface to engage the sealing element 22. In one embodiment, the disk 58 of support elements 54, 56 is fabricated from tear resistant fabric that is sandwiched between layers of more rigid material, e.g., plastic, to create the compliant hinges 66. The compliant nature of the support elements 54, 56 and the resilient links 60 enable the support module 20 to conform to boreholes having different cross sectional profiles and diameters.

One characteristic of the support module 20 is its ability to transfer loads axially along axis 16 (FIGS. 1-4) from a plane along which each support element 54, 56 lies. In certain embodiments, the disk 58 of support elements 54, 56 may be opened or collapsed by either a compliant or non-compliant mechanism. The support module 20 illustrated in FIGS. 8-10 shows a compliant mechanism. This embodiment of the support module utilizes the resiliency or compliance of its elements (e.g., the resilient links 60 and the support elements 54, 56) to attain its movement from its biased collapsed configuration to its operable configuration. Additionally, the inherent compliance of the support module 20 in the radial direction allows for resilient links 60 corresponding to different support elements to expand by different amounts as required for non-circular borehole.

Figure 11:
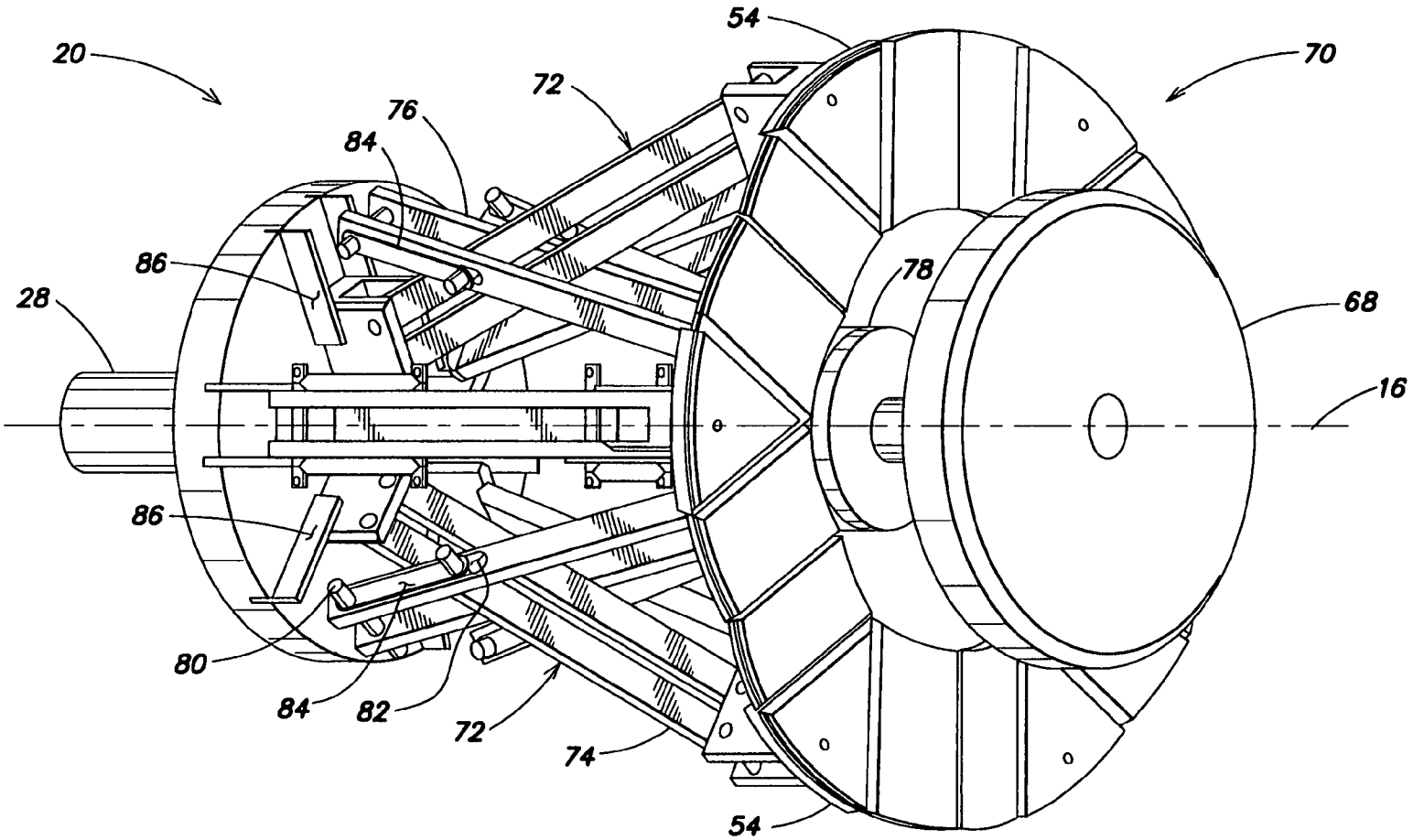
FIG. 11 is a side perspective view of a support module of another embodiment of the invention.

Referring to FIG. 11, there is generally indicated at 70, a support module of another embodiment of the present invention. Identical or similar components referenced in support module 20 are identified by identical reference numbers in FIG. 11 for support module 70. As shown, the support module 70 is substantially similar to support module 20, except that the resilient links 60 of support module 20 are replaced with pivoting mechanical links, each generally indicated at 72. Specifically, the support module 70 includes several pivoting links 72 that allow the support module to move between a collapsed configuration and an operable configuration.

In one embodiment, six pivoting links 72 are provided. Each pivoting link 72 is a scissor-type mechanism having the ends of one pair of arms 74 connected to the base 52 by linkage pins (not designated) and opposite ends of the pair of arms 74 connected to a support element 54 by another pair of linkage pins (not designated). For each pivoting link 72, the ends of another pair of arms 76 are similarly connected to the base 52, with their opposite ends being attached to an annular member 78. The pivot links 72 enable the support module 70 to rotate independently about an axis (e.g., axis 16 in FIGS. 1-4) while allowing the rotation of its respective support elements 54, 56 about another axis. These two independent rotations enable the support module 70 to expand to its operable configuration so as to engage the sealing element, for example. Also, this construction enables the expansion of the support module 70 within a non-circular borehole or pipe.

This motion is made possible by the movement of an intermediate pin 80 formed on one pair of arms 74 that slides within an elongated slot formed in the mating pair of arms 76. This construction enables the support elements 54, 56 to expand differently with respect to one another, thus enabling the disk 58 to open within boreholes that are oblong or elliptical, for example. Springs 84 may be provided to contract or bias the support module 70 to its collapsed configuration. As shown, the each spring 84 is connected to the linkage pin and the intermediate pin 80 so as to apply a collapsing force to the pair of arms 74. It should be noted that the compliant version of the support module, e.g., support module 20, operates in a similar manner to the non-compliant version in that the resilient links 60 are normally biased in their collapsed state and the provision of an axial force (e.g., by sealing element 22) expands the support module 20 to its operable configuration.

In certain embodiments, the provision of an intermediate support element 68 may be provided to fill a gap created by the disk 58 of the support elements 54, 56 as the support module (20 or 70) expands. In addition, shims 86, preferably fabricated from stainless steel, may be included to provide a restoring force to bring the support module 70 back to its collapsed configuration. The shims provide mechanical limits to the rotation of the opening arms, mechanical or compliant, with respect to the axis 16. This limit of the rotation of the arms takes place while the support element conforms to the cross sectional geometry of the borehole.

In operation, and with further reference back to FIGS. 1-4, the anchoring module 18 is employed to anchor or secure the system 10 in place. One of the support modules (either the compliant support module 20 or the non-compliant support module 70) is employed to engage or provide a resistance surface to the sealing element 22. When using either support module 20 or 70, the anchoring module 18 and the support module are positioned adjacent one another along axis 16. The anchoring module 18 secures the system in place, and, as discussed above, is capable of conforming to the geometrical variations (for example, slight bends or turns) along the axis 16 and the cross section of the borehole 14. The support module 20 or 70 is held in place against the anchoring module 18, and opened and closed by forces applied to the compliant links 60 of the compliant support module 20 and to the pivoting links 72 of the non-compliant support module 70. The support elements 54, 56 of the support modules 20 or 70 are capable of conforming to the profile of the borehole 14 in which they open to create a surface against which the sealing element 22 engages. Also, the support module 20 or 70 may be retracted without external manipulation because it stores potential energy to bias the support module to its collapsed configuration.

The arrangement is such that the anchoring module 18 and support modules 20 or 70 support the sealing element 22 to seal the passageway 12 of the borehole 14. Although shown as a separate element, the sealing element 22 in a certain embodiment embodies an inflatable element that may be designed to have the shaft 28 extend therethrough. Thus, the sealing element 22 may be configured similarly to the inflatable bladder 26 in that pressurized fluid delivered through the shaft 28 is used to expand the sealing element. In certain embodiments, the following sequence may be followed. First, the anchoring module is deployed. Next, the support element is deployed, with the inflatable sealing acting on the support element. Once deployed, the sealing element 22 seals the borehole 14 so that other operations, such as harvesting oil or natural gas, may take place downstream within the borehole. In certain embodiments, the sealing element 22 and the inflatable bladder 26 may be fabricated from any elastomeric material adapted to withstand the pressure, temperature, and chemical characteristics of the fluids inside the borehole.

Figure 12:
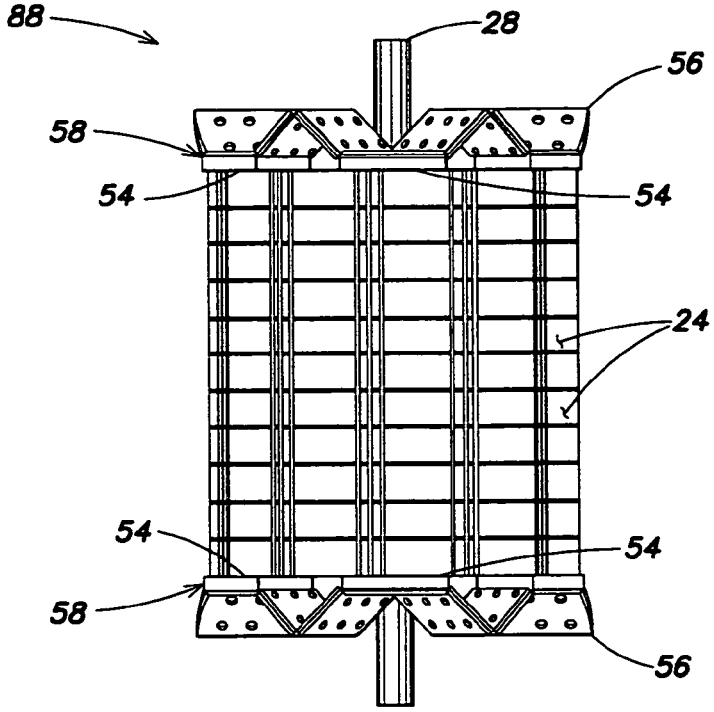
FIG. 12 is a side elevational view of an anchoring module of another embodiment of the invention.

Referring to FIG. 12, there is generally indicated at 88 an anchoring module of another embodiment of the invention. Again, reference numbers used to designate similar or identical parts in anchoring module 18 are used herein for anchoring module 88. Apart from the differences described below, the anchoring module 88 operates similarly to anchoring module 18.

As shown, the anchoring module 88 includes a series of compliant rings 24 arranged along the support shaft 28. As disclosed above, any number of compliant rings 24 may be provided depending on the required holding force to be provided by the anchoring module 88. Compliant support elements 54, 56 arranged as a disk 58 are provided at each end of the anchoring module 88 so that a planar surface of the outer compliant ring 24 engages its respective support elements 54, 56. The support elements 54, 56 are arranged in a similar manner to the support elements of the support modules 20, 70 so that either end of the anchoring module 88 may be used to engage and provide a resistance force to a sealing element, for example. It should be understood that only one end of the anchoring module 88 may be configured to have a support element 54, 56 when placing only one sealing element 22 within the borehole 14.

Figure 13:
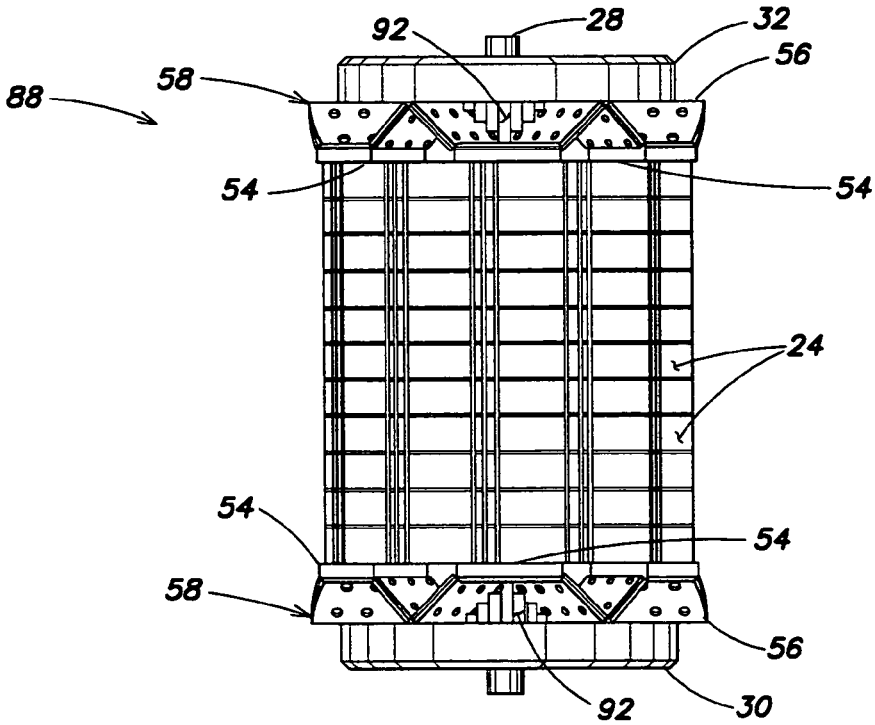
FIG. 13 is a side elevational view of the anchoring module shown in FIG. 12 having anti-extrusion blades of an embodiment of the invention.

FIG. 13 illustrates the same embodiment of the anchoring module 88 shown in FIG. 12 except for the details of anti-extrusion blades 92. Anchoring module 88 includes a series of compliant rings 24 held in place along the shaft 28 by support collars 30, 32. As shown, the support collars 30, 32 hold the compliant rings 24 and support elements 54, 56 at each end of the anchoring module 90 in place. In addition, the anchoring module 88 may include anti-extrusion blades 92 that slide in the axial direction as the support elements are deployed. The anti-extrusion blades 92 prevent the sealing element 22 from entering into gaps created between the support elements 54, 56. The anti-extrusion blades keep the sealing element 22 from extruding through the gaps.

Figure 14:
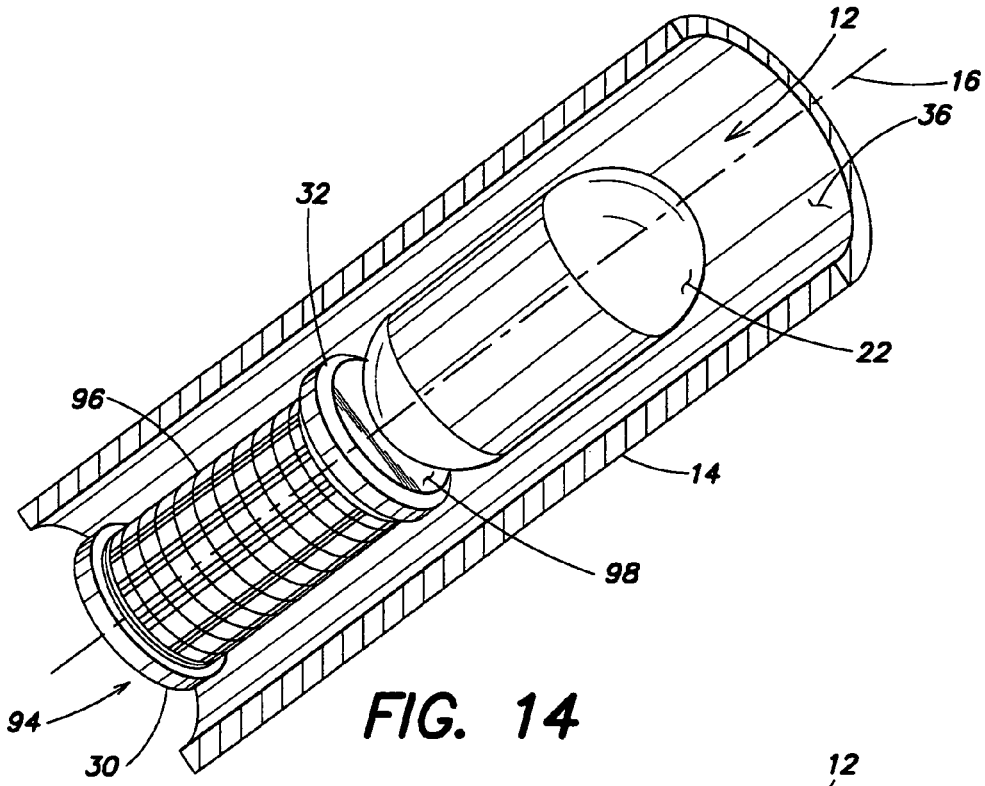
FIG. 14 is a perspective view of a system of another embodiment of the present invention in which a support module is integrated into an anchoring module for blocking a generally tubular structure.
Figure 15:
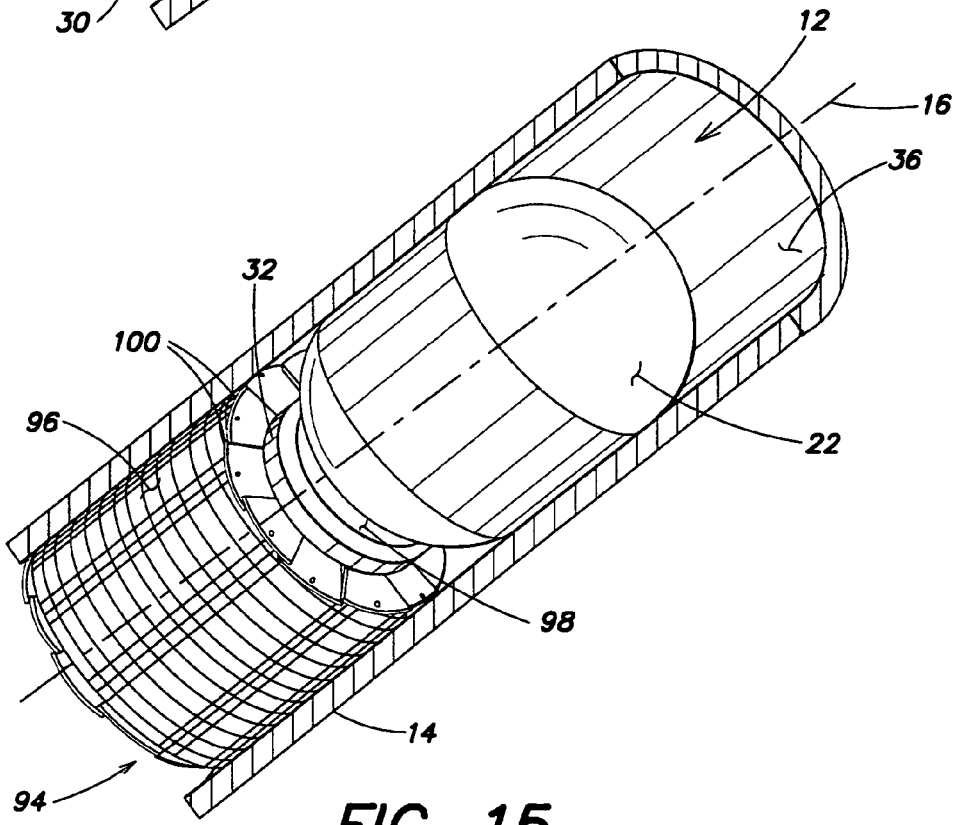
FIG. 15 is a perspective view of the system shown in FIG. 14 with an anchoring module of the system shown in a secured position within the tubular structure.

FIGS. 14 and 15 illustrate a perspective view of another system, generally indicated at 94, for sealing an interior of a generally tubular structure of another embodiment of the present invention. As shown in FIG. 14, the system 94 includes an anchoring module, generally indicated at 96, having a series of compliant rings 24 that are held in place between two end caps 30, 32. In addition to securing the compliant rings 24, the support collars also provide a surface 98 against which the sealing element 22 engages. The anchoring module 96 operates in a similar manner to the anchoring modules described above.

FIG. 15 illustrates the system 94 shown in FIG. 14 in an operable or engaged position in which the compliant rings 24 are expanded (e.g., by an inflatable bladder, not shown) to secure the system 94 within the borehole 14. As shown, the system 94 further includes an annular array of anti-extrusion blades 100 that expand radially as the compliant rings 24 expand. One purpose of the anti-extrusion blades 100 is to assist in preventing the sealing element 22 from being captured between the anchoring module 96 and the interior surface 36 of the borehole 14 thereby damaging the sealing element. The anti-extrusion blades 100 lie along a plane generally perpendicular to the direction of the axis 16 and parallel to the plane of the end of the outer-most compliant ring 24.

Figure 16:
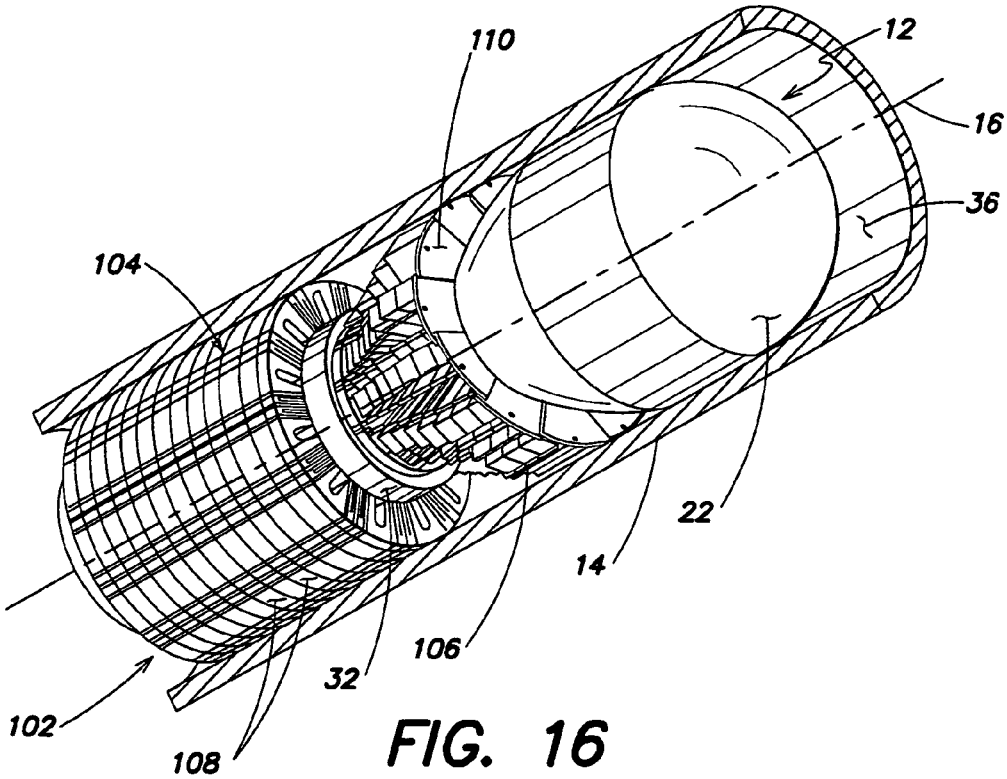
FIG. 16 is a side perspective view of a system of yet another embodiment of the present invention in which a support module is integrated into an anchoring module for blocking a generally tubular structure.

FIG. 16 illustrates yet another embodiment of a system of the present invention, generally indicated at 102, for sealing and sealing the passageway 12 of the borehole 14. The system 102 includes an anchoring module 104 that is substantially similar to the anchoring modules discussed above. However, the system 102 includes a support module 106 which is composed of a series of expandable compliant rings, each indicated at 108. As shown, the compliant rings 108 of the support module 106 expand radially outwardly in a cone-shaped fashion so that the compliant rings adjacent to the anchoring module 104 are smaller in diameter than the compliant rings adjacent to the sealing element 22. Anti-extrusion blades 110 may be further provided at the end of the support module 106 adjacent the sealing element 22 to prevent the sealing element from entering the space between the anchoring module 104 and the support module 106 and the interior surface 36 of the borehole 14. The compliant rings 108 of the support module 106 may be expanded and retracted in a similar manner to the compliant rings 24 of the anchoring module 18, for example.

A device may be positioned between the compliant rings 108 of the support module 106 and the shaft 28 to expand the compliant rings to their operable position. In one embodiment, the device may be in the form of an inflatable bladder (not shown). Pressurized fluid may be delivered to the inflatable element via the shaft 28 for sealing and subsequently sealing the passageway 12 of the borehole 14.

Figure 17:
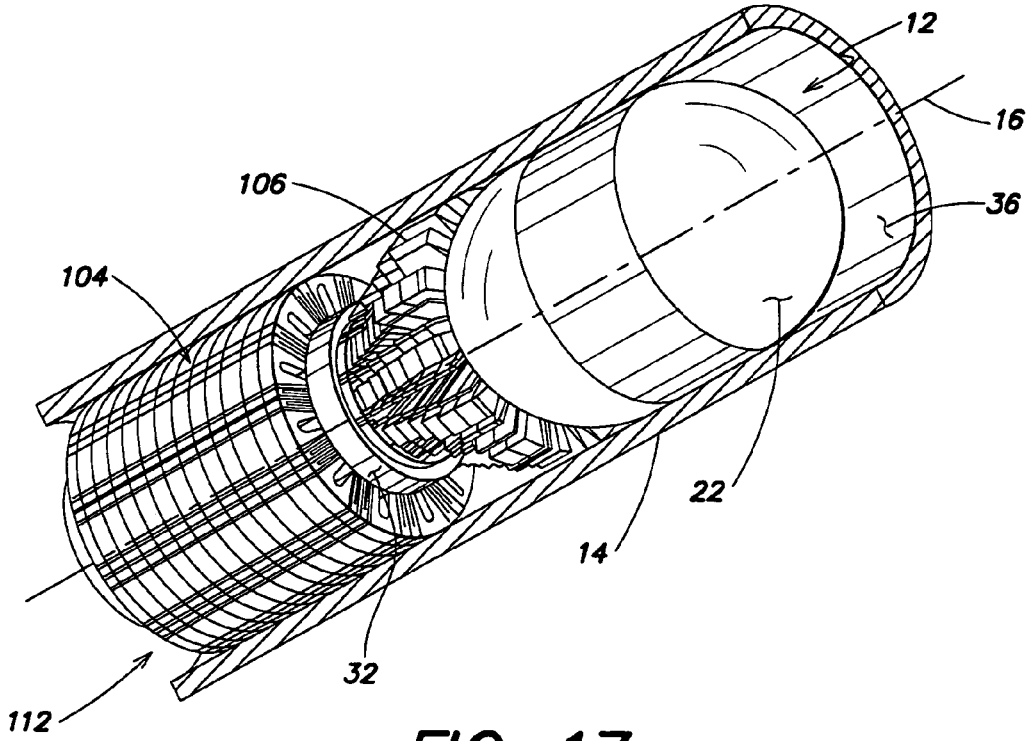
FIG. 17 is a side perspective view of a system of another embodiment of the present invention for blocking a generally tubular structure.

FIG. 17 shows a system 112 identical to the system 102 shown in FIG. 16, except the system 112 is configured without the anti-extrusion blades 110. As shown, the system 112 includes the anchoring and support modules 104, 106, which are adapted to axially support the sealing element 22.

Thus, it should be observed that the anchoring systems described herein are modular in construction. One module of the system may be designed to anchor the system to an interior surface of the borehole. Another module of the system may be designed to support a sealing element. In one embodiment, the module is a support or back-up module that employs an expandable surface that is capable of expanding to the diameter of the interior of the borehole. These modules may be combined in a variety of configurations to support a sealing element, such as an inflatable sealing element. The self-conforming nature of the modules obviate the need for prior knowledge of the borehole topology or complex sensor systems used to chart this data.

In addition to anchoring, the system may be adapted to be employed as a crawling apparatus used to deploy tools for inspection of drilled well bores or for exploratory robots. For example, a method of conveying devices inside a structure may comprise securing at least two anchoring modules in series within the structure, and moving at least one of the two anchoring modules an incremental amount. Tools connected to the anchoring modules outside of the anchoring modules may be conveyed in this manner.

While this invention has been shown and described with references to particular embodiments thereof, those skilled in the art will understand that various changes in form and details may be made therein without departing from the scope of the invention, which is limited only to the following claims.

What is claimed is:

1. An anchoring module adapted to be secured within a structure, the anchoring module comprising:

at least one compliant ring adapted to radially expand from a substantially relaxed position;

the at least one compliant ring segmented into a plurality of generally wedge-shaped structural segments circumferentially arranged; each structural segment is connected by at least one interconnecting compliant portion;

an expandable device positioned within the at least one compliant ring to expand the at least one compliant ring from its substantially relaxed position to interface with the structure; and at least one opening in the structural segments with at least one pin extending through the at least one opening.

2. The anchoring module of claim 1, wherein each structural segment of the plurality of generally wedge-shaped structural segments is adapted to move radially outwardly with respect to adjacent structural segments.

3. The anchoring module of claim 1, further comprising two or more compliant rings positioned adjacent one another along a common axis, wherein structural segments of adjacent compliant rings are aligned with respect to each other by the at least one pin.

4. The anchoring module of claim 1, wherein the at least one compliant ring is configured to be expandable from the substantially relaxed position to an expanded position, and wherein the at least one compliant ring is configured such that the maximum diameter of the at least one compliant ring in its expanded position is approximately 1.69 times greater than the diameter of the at least one compliant ring in its substantially relaxed position.

5. The anchoring module of claim 1, wherein the expandable device comprises an inflatable bladder.

6. The anchoring module of claim 5, further comprising a pair of end caps, and wherein the at least one compliant ring and the inflatable bladder are positioned between the pair of end caps.

7. The anchoring module of claim 1, further comprising a sealing element adapted to block an interior of the structure.

8. The anchoring module of claim 7, further comprising a shaft, the at least one compliant ring, the expandable device and the sealing element being mounted on the shaft.

9. The anchoring module of claim 1, wherein the structure is asymmetrical in cross section.

10. An anchoring module adapted to be secured within a structure, the anchoring module comprising:

at least one compliant ring segmented into a plurality of generally wedge-shaped structural segments circumferentially arranged;

each structural segment is connected to one another by at least one interconnecting portion;

means for expanding the at least one compliant ring from its substantially relaxed position to interface with the structure; and at least one opening in the structural segments with at least one pin extending through the at least one opening.

11. The anchoring module of claim 10, wherein each structural segment of the plurality of generally wedge-shaped structural segments is adapted to move radially outwardly with respect to adjacent structural segments.

12. The anchoring module of claim 10, further comprising two or more compliant rings positioned adjacent one another along a common axis, wherein structural segments of adjacent compliant rings are aligned with respect to each other by the at least one pin.

13. The anchoring module of claim 10, wherein the at least one compliant ring is configured to be expandable from the substantially relaxed position to an expanded position, and wherein the at least one compliant ring is configured such that the maximum diameter of the at least one compliant ring in its expanded position is approximately 1.69 times greater than the diameter of the at least one compliant ring in its substantially relaxed position.

14. The anchoring module of claim 10, wherein the means for expanding the at least one compliant ring comprises an inflatable bladder.

15. The anchoring module of claim 10, further comprising a sealing element adapted to block an interior of the structure.

16. The anchoring module of claim 15, further comprising a shaft, the at least one compliant ring, the means for expanding the at least one compliant ring, and the sealing element being mounted on the shaft.

17. The anchoring module of claim 10, wherein the structure is asymmetrical in cross section.

18. A system for sealing a structure, the system comprising:

an anchoring module adapted to interface with an interior surface of the structure;

a support module adapted to transfer a load to the anchoring module, said support module comprising a base; and a plurality of support elements coupled to the base; and wherein the anchoring module comprises at least one compliant ring segmented into a plurality of generally wedge-shaped structural segments circumferentially arranged; and adapted to radially expand from a substantially relaxed position;

an expandable device positioned within the at least one compliant ring to expand the at least one compliant ring from its substantially relaxed position to interface with the structure;

at least one opening in the structural segments with at least one pin extending through the at least one opening; and wherein the plurality of support elements are moveable from a collapsed configuration to an operable configuration in which the plurality of support elements expand radially along a plane generally perpendicular to an axis of the structure.

19. The system of claim 18, wherein adjacently positioned support elements are connected to one another by compliant linkages.

20. The system of claim 18, wherein the support module further comprises at least one compliant link to connect the base and the plurality of support elements.

21. The system of claim 18, further comprising a sealing element adapted to block an interior of the structure, the plurality of support elements being adapted to interface with the sealing element.

22. The system of claim 18, wherein each structural segment is connected to one another by at least one interconnecting portion, and adapted to move radially outwardly with respect to adjacent structural segments.

23. The system of claim 22, wherein the expandable device comprises an inflatable bladder.

24. The system of claim 23, further comprising a pair of end caps, wherein the at least one compliant ring and the inflatable bladder are positioned between the pair of end caps.

25. The system of claim 24, further comprising a sealing element adapted to block an interior of the generally tubular structure, the support module being adapted to interface with the sealing element.

26. The system of claim 25, further comprising a shaft, the anchoring module, the support module and the sealing element being mounted on the shaft.

27. The system of claim 18, wherein the structure is asymmetrical in cross section.

28. A method of sealing a structure comprising:

securing an anchoring module to an interior surface of the structure;

supporting a sealing device with the anchoring module and transferring a load provided by the sealing device on the anchoring module with a support module positioned between the anchoring module and the sealing device wherein the anchoring module comprises at least one compliant ring segmented into a plurality of generally wedge-shaped structural segments circumferentially arranged;

at least one opening in the structural segments with at least one pin extending through the at least one opening; and wherein the sealing device comprises an inflatable sealing element.

29. The method of claim 28, wherein the structure is asymmetrical in cross section.

30. A method of conveying devices inside a structure comprising:

providing at least two anchoring modules adapted to be secured within the structure, each one of the at least two anchoring modules comprising:

at least one compliant ring adapted to radially expand from a substantially relaxed position;

the at least one compliant ring segmented into a plurality of generally wedge-shaped structural segments circumferentially arranged;

connecting each structural segment to at least one interconnecting compliant portion and having at least one opening in the structural segments with at least one pin extending through the at least one opening; and an expandable device positioned within the at least one compliant ring to expand the at least one compliant ring from its substantially relaxed position to interface with the structure;

securing the at least two anchoring modules in series within the structure; and moving at least one of the two anchoring modules an incremental amount along the axis of the structure.

31. An anchoring module adapted to be secured within a structure, the anchoring module comprising:

two or more compliant rings segmented into a plurality of generally wedge-shaped structural segments circumferentially arranged;

an expandable device positioned within the two or more compliant rings to expand the two or more compliant rings from its substantially relaxed position to interface with the structure; and wherein the two or more compliant rings are positioned adjacent one another along a common axis and structural segments of adjacent compliant rings are aligned with respect to each other by at least one pin extending through at least one opening in the structural segments.

32. An anchoring module adapted to be secured within a structure, the anchoring module comprising:

two or more compliant rings segmented into a plurality of generally wedge-shaped structural segments circumferentially arranged;

means for expanding the two or more compliant rings from its substantially relaxed position to interface with the structure; and wherein two or more compliant rings are positioned adjacent one another along a common axis and structural segments of adjacent compliant rings are aligned with respect to each other by at least one pin extending through at least one opening in the structural segments.

* * * * *